United States Patent [19]

Fardén

[11] 4,176,477

[45] Dec. 4, 1979

[54] COMPACT UNIT FOR EXCAVATING, COMPACTING AND LOADING

[76] Inventor: Arne Fardén, Harjagersgatan 7,, 245 00 Staffanstorp, Sweden

[21] Appl. No.: 882,096

[22] Filed: Mar. 1, 1978

[51] Int. Cl.[2] ..... E02F 5/22

[52] U.S. Cl. ..... 37/104; 172/800

[58] Field of Search ..... 37/104, 42 R, 42 VL, 37/10, 141 R, 141 T; 172/800-809

[56] References Cited

U.S. PATENT DOCUMENTS

| | | | |
|---|---|---|---|
| 3,466,766 | 9/1969 | Kahlbacher | 37/42 VL |
| 3,478,450 | 11/1969 | Cunningham | 37/141 R |
| 3,515,224 | 6/1970 | Seaberg | 172/666 X |
| 3,726,347 | 4/1973 | Hyman | 37/105 X |
| 3,755,930 | 9/1973 | Brandt et al. | 37/10 |
| 3,808,714 | 5/1974 | Reissinger et al. | 37/42 VL |

FOREIGN PATENT DOCUMENTS

| | | | |
|---|---|---|---|
| 2236381 | 2/1974 | Fed. Rep. of Germany | 37/141 R |
| 2421713 | 5/1974 | Fed. Rep. of Germany | 37/42 VL |
| 937195 | 8/1948 | France | 37/141 R |
| 1169453 | 12/1958 | France | 37/50 |

*Primary Examiner*—E. H. Eickholt

*Attorney, Agent, or Firm*—Strauch, Nolan, Neale, Nies & Kurz

[57] ABSTRACT

A component unit for excavating, compacting and loading material on a horizontal or sloping surface. A carrier beam pivotal in the horizontal and vertical plane carries via a plurality of elastic members an excavating blade and further an amplitude limiter between said beam and said blade. The amplitude limiter comprises a sliding body carried by said blade and provided with a top sliding surface and a side sliding surface having an angle of preferably 135° to the top sliding surface. The carrier beam carries partly a top block above and adjustable in relation to the top sliding surface partly a stop member portion along and on a small distance from the side sliding surface.

6 Claims, 9 Drawing Figures

COMPACT UNIT FOR EXCAVATING, COMPACTING AND LOADING

BACKGROUND OF THE INVENTION

This invention relates to a compact unit for excavating, compacting and loading of material on a horizontal or sloping surface for levelling the same.

It is known to use for such purposes a levelling or compact unit, which comprises an oblong excavation blade, which via elastic members is adjustably supported on an adjustable carrier means, and which at its lower edge is provided with cutting tools or teeth and with a compacting means. Said excavation blade carries a vibrator means, which causes the excavation blade and its teeth and compacting means to vibrate substantially vertically. The arrangement with a vibrator means, however, renders the unit complicated and expensive.

The present invention has the object of bringing about a compact unit for said purposes, which has high working capacity and, due to the absence of a vibrator means, is of simplified design, and which, besides, renders possible a highly variable adjustment of the excavation blade.

This object is achieved by a compact unit for excavating, compacting and loading of material on a horizontal or sloping surface, which unit comprises an oblong excavation blade, which is provided at its lower edge in relation to the advancing direction with forwardly-downwardly directed breaking teeth and behind the same with a compactor. The unit according to the invention is characterized in that the excavation blade is supported via elastic members by a carrier beam, which is limited pivotal in the horizontal and vertical plane, and at least one amplitude limiter is attached between the excavation blade and the carrier beam, which amplitude limiter comprises a sliding body supported by the excavation blade and having an upper top sliding surface and an oblique sliding surface, which is formed by a lateral block and preferably has an angle to the top sliding surface of 135°, and a stop member, which is supported by the carrier beam and has a top block above the top sliding surface and adjustable in relation thereto, and a stop member portion extending along the sliding surface of the lateral block, but at a certain small distance thereto. A supplementary excavation blade or a sighting shovel preferably is attached detachably above and along the upper edge of the excavation blade and supported on supporting sheets attached to the carrier beam.

The invention is illustrated by way of an embodiment shown in the accompanying drawings.

Figure 1:
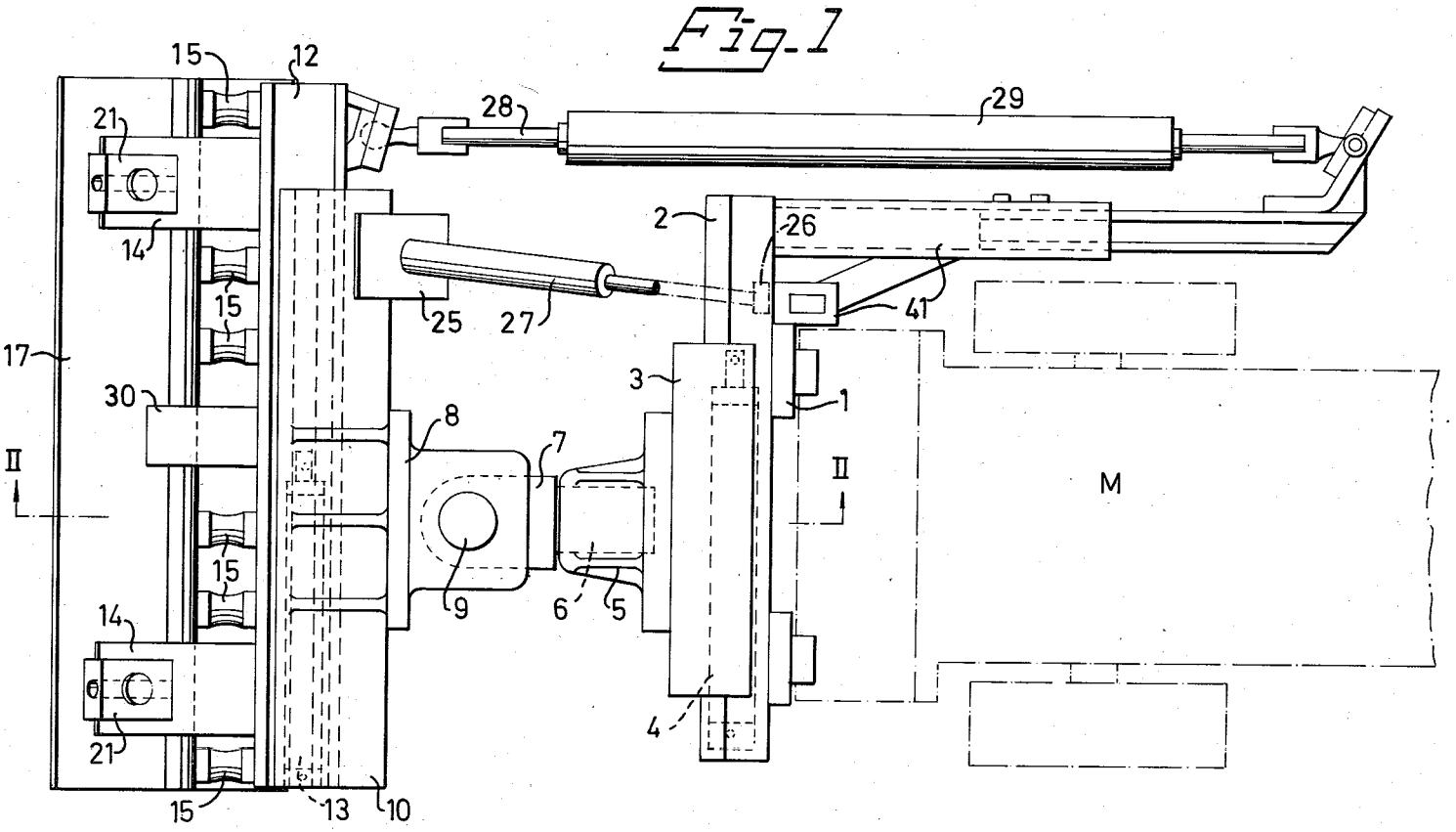
FIG. 1 is a horizontal view of the compact unit according to the invention.
Figure 2:
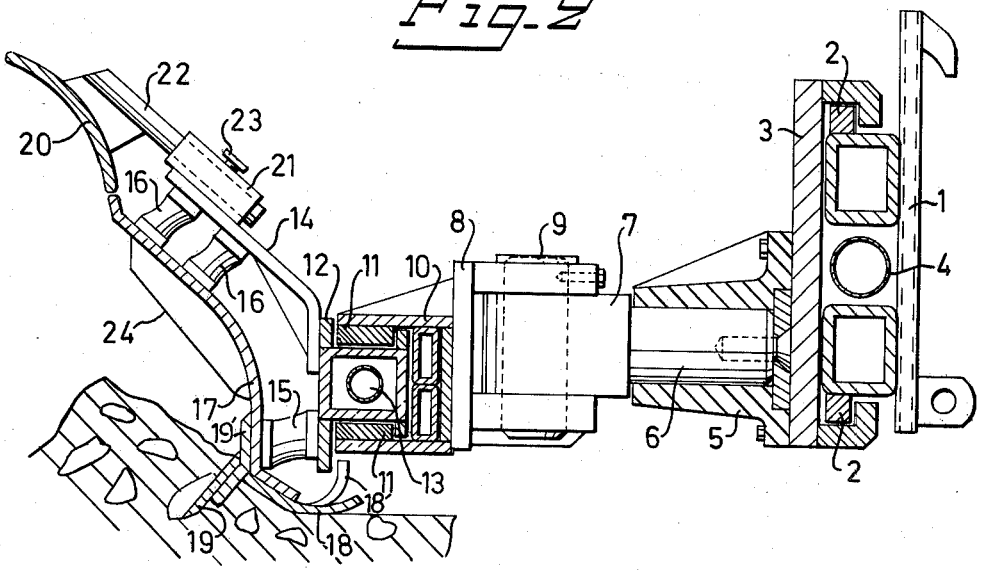
FIG. 2 is a vertical section along the line II-II in FIG. 1.

The compact unit according to the invention shown in FIGS. 1 and 2 comprises a holder 1 intended to be detachably attached to the front portion of a motor vehicle, for example road grader, tractor, truck, four-wheel loader or the like, indicated in FIG. 1 by dash-dotted lines and designated by M. The holder 1 is provided with two horizontal guides 2, along which a slide 3 is movable by means of a hydraulic piston and cylinder device 4 or an electric screw spindle device. From the slide 3 a bearing 5 projects for a horizontal axle journal 6, which rotatably but axially unmovably is supported in the bearing 5. The axle journal 6 has a head 7, at which a fork-shaped carrier body 8 is hinged by means of an axle 9 mounted perpendicularly relative to the axle journal 6. At said carrier body 8 a guide beam 10 with two guides 11 is attached which form a guide for a substantially H-shaped carrier beam 12, which is movable along the guides 11 by means of a piston and cylinder device 13. Along the lower portion of the carrier beam 12 a plurality of elastic members 15 are distributed, and near the upper portion of each end of the carrier beam 12 a supporting sheet 14 is attached and carries a pair of elastic members 16. By means of said elastic members 15, 16 an excavation blade 17 with slightly bulging cross-section is supported, at the lower edge of which a compactor 18 extending along the entire excavating blade 17 and an angular holder 19' are attached, which carries a plurality of forwardly-donwardly directed breaking teeth 19 distributed along the excavation blade with a division of, for example, 50 mm. The compactor 18 is provided with stop tips 18', which project upward behind the lower portion of the beam 12 and contact the same, so that the elastic members 15, 16 are prevented from being drawn to pieces when the vehicle is driven backward for levelling earth or the like by means of the compactor 18. The compactor 18 as well as the breaking teeth 19 are attached exchangeably and consist of manganese steel or a similar wear-resistant material. The excavation blade 17 can be extended upwardly by means of a supplementary excavation blade 20, which is supported adjustably and detachably thereby, that on each supporting sheet 14 a guide 21 is attached for a guide pin 22, which is rigidly connected with the supplementary excavation blade 20 and can be locked by a locking screw 23.

On the forward bulging side of the excavation blade 17 a plurality of stiffening and partition sheets 24 are attached perpendicularly to the longitudinal direction of the excavation blade.

Figure 5:
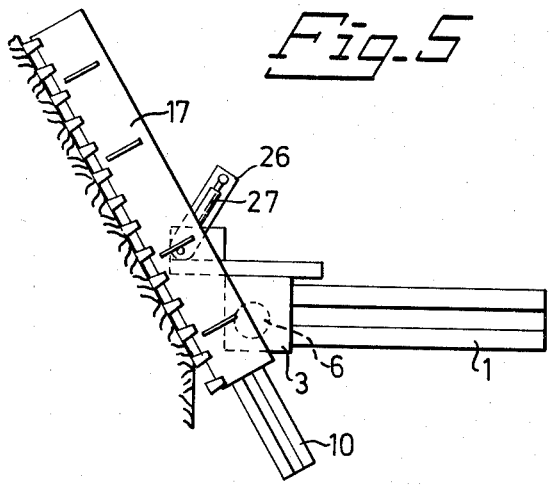
FIGS. 5 and 6 show on a reduced scale and in a schematic manner the unit with its excavation blade set in different positions.
Figure 6:
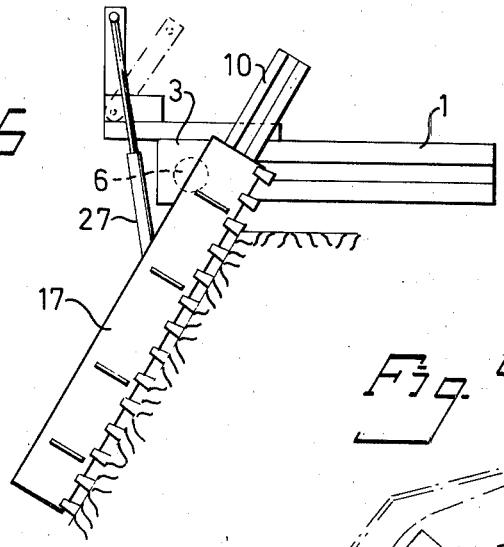

Between a holder 25, FIG. 1, on the guide beam 10 and a supporting member 26 attached on the slide 3, a hydraulic piston and cylinder device 27 is hingedly attached, one end of which is adjustable in different inclinations by means of the supporting member 26, as is apparent from the different positions of the device 27 in FIGS. 5 and 6. In addition, a stay member 28 with adjustable length by means of a hydraulic piston and cylinder device 29 is hingedly attached between the carrier beam 12 and a supporting member 41 attached to the holder 1.

Figure 3:
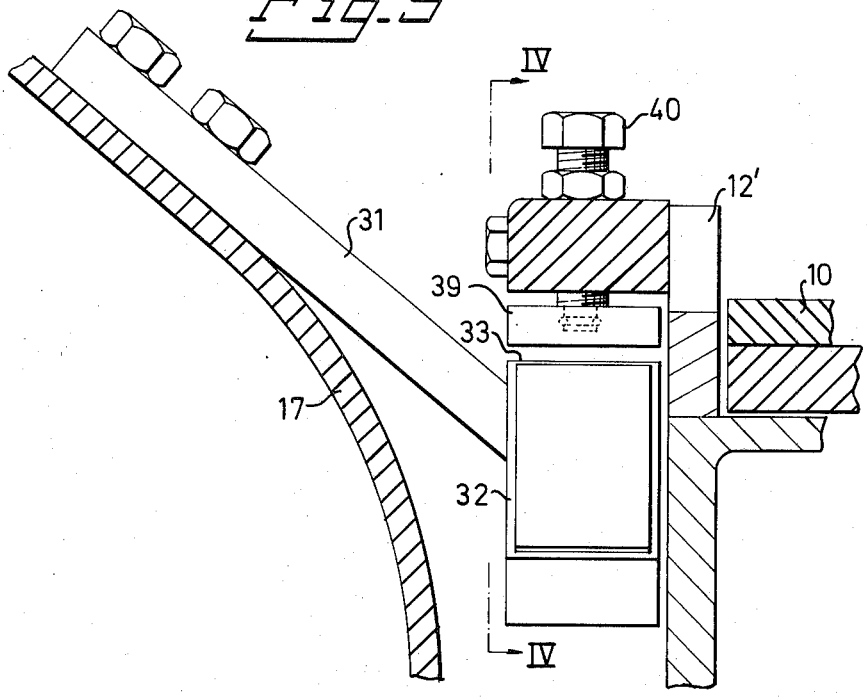
FIG. 3 shows on an enlarged scale a portion of the unit by way of a section similar to that in FIG. 2.
Figure 4:
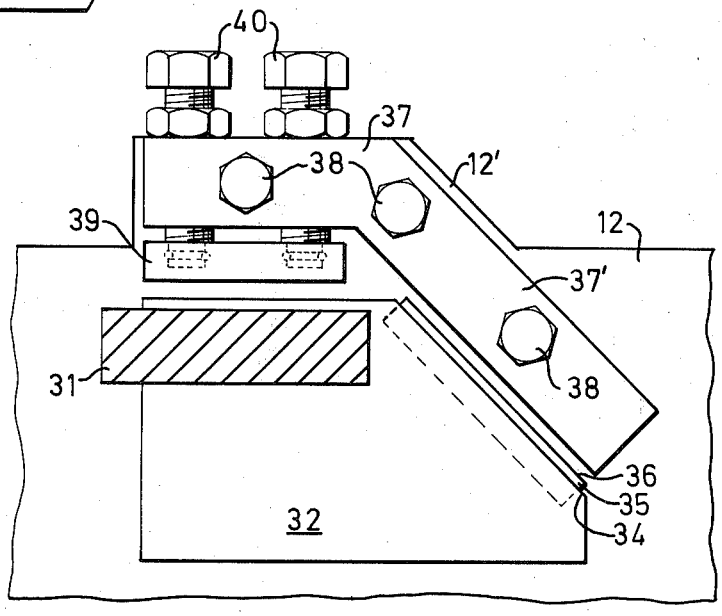
FIG. 4 is a vertical section along the line IV—IV in FIG. 3.

At the centre of the longitudinal extension of the carrier beam 12 an adjustable amplitude limiter 30 is provided, which is only indicated in FIG. 1, omitted in FIG. 2, but more clearly shown in FIGS. 3 and 4. In said lastmentioned Figures is shown, that on the upper portion of the rear side of the excavation blade 17 an arm 31 is attached, which supports a sliding member 32 located at a small distance, for example 8 mm, from the front side of the carrier beam 12, which sliding member has an upper top sliding surface 33 and a lateral surface 34, which is provided with a groove with a strip-shaped lateral block 35 of steel or a plastic material, such as DELRIN. The free sliding surface 36 of said block forms with the top sliding surface 33 an angle of 135°.

A stop member 37 is attached by screws 38 to a holder portion 12' and the carrier beam 12 and extends along the upper portion and one side of the sliding member 32, in such a manner, that the stop member 37 is located with a portion above and at a certain distance from the top sliding surface 33, and with a portion 37' along the lateral sliding surface 36, but at a certain distance, for example 5 mm, therefrom. In the space between the top sliding surface 33 and the portion of the stop member 37 located thereabove, a stop plate 39, preferably of the same material as the lateral block 35, is supported by two set screws 40 at an adjustable distance from the top sliding surface 33.

Figure 7:
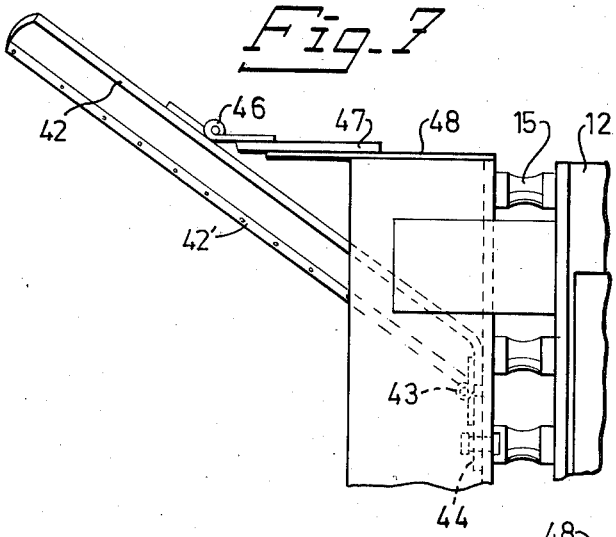
FIG. 7 is a horizontal view of a portion of the unit.
Figure 8:
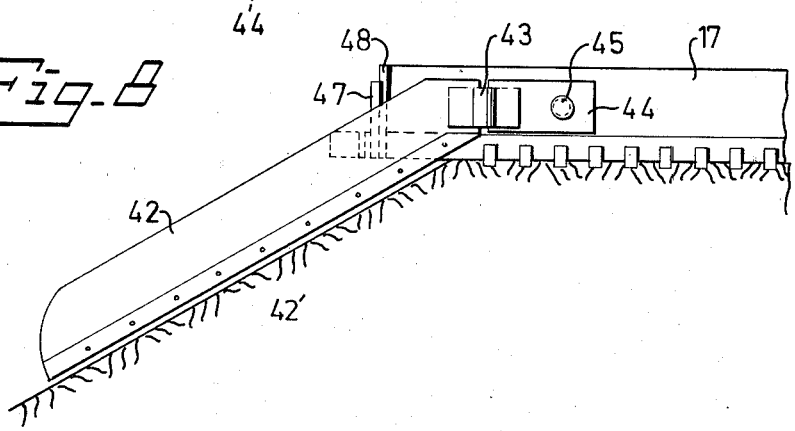
FIG. 8 shows on a reduced scale the unit portion in FIG. 7.

FIGS. 7 and 8 show a preferably bulging and detachable ploughshare 42 with exchangeable cutting edge 42' and connected to the excavation blade 17 thereby that the ploughshare 42 by means of a hinge 43 is connected to a plate 44, which is mounted on an axle 45 attached to the excavation blade. The ploughshare 42 projects from the excavation blade and is by means of a hinge 46 connected to a an adjusting plate 47, which by movement along a lateral sheet 48 on the excavation blade is adjustable for the desired setting of the ploughshare 42, for example in the position shown in FIG. 8, where the ploughshare is used for moving upward excess masses and levelling the same on the road or laying them in strands. The ploughshare 42 also may serve for a plurality of other purposes, such as levelling road-sides or slopes, cutting grass and grass-roots along the road-side, trimming etc.

Figure 9:
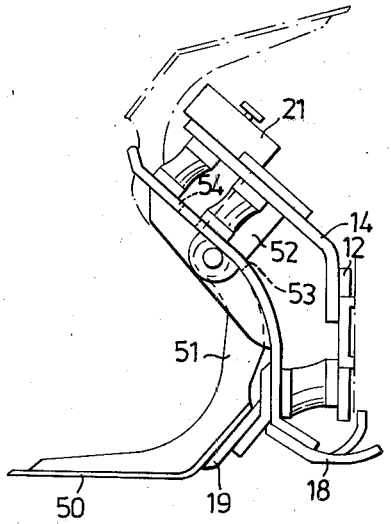
FIG. 9 is a lateral view of a portion of the unit.

Instead of the supplementary excavation blade 20 shown in FIGS. 1,2, a sighting shovel 50 can be arranged in front of the excavation blade 17, as shown in FIG. 9. The sighting shovel 50 is hingedly suspended on four suspending brackets 52, one bracket on each side of the supporting sheets 14, which brackets are detachably attached adjacent the guides 21 on the supporting sheets 14 and extend through slits 53 in the excavation blade 17, which at its upper edge is provided with additional slits 54 to provide space for the four arms 51 of the sighting shovel 50.

The sighting shovel 50 is adjustable in a lower position where it rests against the breaking teeth 19, indicated by fully drawn lines, and in a folded-up position, indicated by dash-dotted lines, and preferably the shovel can be locked in both positions. The pivotal movement of the sighting shovel can be effected manually.

The compact unit according to the invention shows the advantages, that the design described and the mutually movable details render it possible to adjust the excavation blade 17, by a suitable setting of the piston and cylinder devices 27 and 29, in the horizontal plane by a pivotal movement of at maximum about 35° in one direction and the other about the axle 9. The excavation blade 17, further, is adjustable between the position shown in FIG. 5, where the excavation blade forms with the horizontal plane an angle of about 50° above said plane, and the position shown in FIG. 6, where the excavation blade forms with the horizontal plane an angle of about 50° beneath said plane. The excavation blade, further, is adjustable simultaneously within the extreme positions according to FIGS. 5, 6 about the axle 9, so that the desired setting can be satisfied to a high degree.

The compact unit according to the invention further has the advantages, that the excavation blade, when it is being advanced while excavating and simultaneously the resulting surface is compacted by the compactor 18, is vibrated when it meets resistance of varying hardness, because it is supported on the elastic members 15,16. The amplitude of said vibrations is limited by the amplitude limiter 30 in such a manner, that, when the excavation blade moves the sliding member 32 attached thereon in upward direction, the lateral block 35 contacts the adjacent stop member portion 37' and slides along the same until the top sliding surface 33 contacts the top block 39 and limits the amplitude. Thereafter the elastic members 15,16 due to the recoil effect pull the excavation blade downward to the starting position, and the compactor 18 carries out the desired surface compacting. During the sliding movement of the lateral block 35 upward along the adjacent oblique stop member portion 37', the excavation blade, and therewith also the compactor, are caused to move slightly, for example through 3 mm, in the longitudinal direction of the excavation blade to the left, seen from the front, thereby favourably affecting the working result of the excavation blade and compactor. The distance of the top block 39 from the sliding surface 33 is adjusted by the set screws 40, so that, with regard paid to the consistency of the excavated material in question, the stone content etc. and the advancing speed, the desired vibration amplitude, for example at maximum 10 mm, is obtained.

The compact unit shows the further advantage that the excavation blade 17 can be extended in height, when required, and without affecting the vibrations of the excavation blade and their amplitude, because the supplementary excavation blade 20 is supported by the carrier beam 12 free from the excavation blade. The supplementary excavation blade, furthermore, is easily attachable and detachable.

The sighting shovel 50 especially shows the advantages as explained in the following. It can replace the four-wheel loader, which normally is required for removing the excess masses resulting from excavation work with a road-grader. This implies that one machine less is required. With the sighting shovel in folded-up position, where it forms an extension in height of the excavation blade, a road-grader is not longer necessary at excavation work and, consequently, one machine less is required. When wet compacted masses are being levelled, such as clay masses, heretofore a thin clay layer of 2–3 cm was peeled off by means of a loading shovel with a sharp cutting edge. This work, however, was rendered difficult due to the strong adherence of the clay on the inside of the shovel. When, however, the sighting shovel 50 is used for this work, it rests against the vibrating breaking teeth 19 so that the sighting shovel at driving vibrates. This has a positive effect on breaking-off the clay layer and possibly also on the loading operation. By means of the sighting shovel the loading of light and dry material, for example gravel and earth, can be carried out also from a sloping surface, for example a road-slope. This is of advantage, because normally it is desired that the material is moved up to a plane surface, for example a road surface, and there collected in a strand before loading.

The compact unit is suitable particularly for use at levelling or adjusting and compacting the surface of roads, lawns, sports grounds, road-slopes, ditches, noise-protection banks etc., for shrub cleaning, snow-clearing, for removing excavated masses in mines, for adjusting the angle between road and road-slope etc., for breaking-off hard moraine gravel and fine-grading of streets in villa areas, before asphalt paving and of bearing layers in industrial buildings before the pouring of concrete floors etc. The compact unit according to the invention, therefore, has a highly versatile range of applications, particularly because it also can easily be attached to a suitable vehicle.

The invention must not be regarded restricted to the embodiment described above and shown in the drawings, because it can be modified with respect to its details within the scope of the invention, for example for reasons of stability or weight. The lateral block can be omitted when the sliding member carrying the lateral block has a suitable sliding surface to the adjacent stop member portion. Two or more amplitude limiters can be provided between the excavation blade and the carrier beam.

I claim:

1. A compact unit for excavating, compacting and loading material on a horizontal or sloping surface, comprising an oblong excavation blade (17) and at the lower edge thereof in relation to the advancing direction both forwardly-downwardly directed breaking teeth (19) and behind the same a compactor (18), characterized in that the excavation blade is supported via a plurality of elastic members (15,16) by a carrier beam (12), which is limited pivotal in the horizontal and vertical plane, and at least one amplitude limiter (30) is attached between the excavation blade (17) and the carrier beam (12), which amplitude limiter comprises a sliding body (32) supported by the excavation blade (17) and having an upper top sliding surface (33) and an oblique sliding surface (36), which is formed by a lateral block (35) and preferably has an angle to the top sliding surface of 135°, and a stop member (37), which is supported by the carrier beam (12) and has a top block (39) above the top sliding surface (33) being adjustable in relation thereto, and a stop member portion (37') extending along the sliding surface (36) of the lateral block, but at a certain small distance thereto.

2. A unit according to claim 1, characterized in that a supplementary excavation blade (20) is detachably attached above and along the upper edge of the excavation blade (17) and is supported by supporting sheets (14) attached to the carrier beam (12).

3. A unit according to claim 1 or 2, characterized in that the carrier beam (12) by means of a hydraulic piston and cylinder device (13) is adjustable along a guide beam (10), which is limited pivotal about an axle (9), which is limited pivotal about a substantially horizontal axle journal (6) supported on a slide (3), which by means of a device, for example a hydraulic piston and cylinder device (4) or an electric screw spindle device, is movable along guides (2) on a holder (1) intended to be supported on a motor vehicle.

4. A unit according to claim 3, at which a staying member (28) with adjustable length is hingedly attached between one end of the carrier beam (12) and a supporting member (41) on the holder (1), characterized in that a hydraulic piston and cylinder device (27) is hingedly attached between a supporting member (26) on the slide (3) and the most adjacent end of the guide beam (10).

5. A unit according to claim 1 or 2, characterized in that suspending brackets (52) are detachably attached to the supporting sheets (14) and extend through slits (53) in the excavation blade (17), and a sighting shovel (50) is hingedly suspended on the brackets (52) for vertical pivotal movement.

6. A unit according to claims 1 or 2, characterized in that a preferably detachable ploughshare (42) is connected via a hinge (43) to a plate (44), which is mounted on an axle (45) supported on the excavating blade (17), and the ploughshare also is connected by a hinge (46) to an adjusting plate (47), which adjustably is attached to a lateral sheet (48) on the excavation blade (17).

* * * * *